US005246128A

United States Patent [19]

Uitz

[11] Patent Number: 5,246,128

[45] Date of Patent: Sep. 21, 1993

[54] PLASTIC CONTAINER AND PALLET SYSTEM

[76] Inventor: Mark O. Uitz, 1050 Crest View Dr., Mountain View, Calif. 94040

[21] Appl. No.: 992,178

[22] Filed: Dec. 17, 1992

Related U.S. Application Data

[60] Division of Ser. No. 865,124, Apr. 8, 1992, which is a division of Ser. No. 685,999, Apr. 12, 1991, Pat. No. 5,123,533, which is a continuation of Ser. No. 587,456, Sep. 19, 1990, abandoned, and a continuation of Ser. No. 449,500, Dec. 1, 1989, abandoned, and a continuation of Ser. No. 336,597, Apr. 7, 1989, abandoned, and a continuation of Ser. No. 157,926, Feb. 18, 1988, abandoned, and a continuation-in-part of Ser. No. 389,703, Jun. 18, 1982, abandoned.

[51] Int. Cl.[5] ..... B65D 6/16

[52] U.S. Cl. ..... 220/4.28; 220/354

[58] Field of Search ..... 220/4.28, 4.33, 297, 220/298, 326, 354

[56] References Cited

U.S. PATENT DOCUMENTS

| | | | |
|---|---|---|---|
| 2,689,057 | 9/1954 | Nudell | 220/346 |
| 2,822,106 | 2/1958 | Fabian | 220/4 F |
| 3,010,673 | 11/1961 | Marconi | 220/298 |
| 3,055,531 | 9/1962 | De Chelbor | 220/21 |
| 3,081,897 | 4/1960 | Livingston | 220/4 F |
| 3,126,843 | 3/1964 | De Laney | 108/901 |

(List continued on next page.)

FOREIGN PATENT DOCUMENTS

| | | | |
|---|---|---|---|
| 834580 | 2/1970 | Canada | 220/4 F |
| 2516108 | 10/1976 | Fed. Rep. of Germany | 100/55.5 |
| 03011139 | 10/1981 | Fed. Rep. of Germany | 206/599 |
| 1171871 | 1/1959 | France | 220/4 F |
| 2291101 | 1/1976 | France | 108/55.1 |
| 335798 | 11/1930 | United Kingdom | 206/83.5 |
| 1067954 | 5/1962 | United Kingdom | 210/22 |
| 1005589 | 9/1965 | United Kingdom | 105/55.1 |
| 1493433 | 5/1976 | United Kingdom | 206/599 |
| 1575143 | 9/1980 | United Kingdom | 108/51.1 |

*Primary Examiner*—Joseph Man-Fu Moy
*Attorney, Agent, or Firm*—Flehr, Hohbach, Test, Albritton & Herbert

[57] ABSTRACT

The plastic container and pallet system includes stackable plastic containers which interlock one with the other when stacked and which similarly interlock with the pallet when stacked thereon. Each container includes a pair of molded end wall structures which incorporate stacking tabs along their upper edge and stacking recesses along their lower edge. Thus, when one container is stacked upon another, the recess on the bottom edge of the upper container mates with the stacking tab on the lower container. Similarly, the pallet is provided with mounting tabs at selected intervals to mate with the stacking recesses on the bottom of each container. Each stacking tab along the top edge of the molded end wall structure of the containers includes a belt notch which is aligned with the belt notch beneath each base runner of the pallet when the containers are stacked on the pallet. Thus, by placing a belt beneath each base runner and up and over the stack of containers utilizing the belt notches in the stacking tabs of the containers on the top level, all of the containers can be secured to the pallet.

The containers are entirely manufactured of a selected plastic material and vibration welded as a complete unit. In one embodiment one of the side walls of the container is made removable to create an office storage system incorporating these containers on the pallet. A positive method for securing the lid on each container is also disclosed.

The pallet is constructed from two parts, a plurality of base runners having affixed thereto at substantially 90° and spaced apart a plurality of cross members. Each of these parts consists of a honeycomb-type construction and are vibration welded or stake welded together.

17 Claims, 8 Drawing Sheets

U.S. PATENT DOCUMENTS

| | | | |
|---|---|---|---|
| 3,371,817 | 3/1968 | Gasbarra et al. | 220/298 |
| 3,410,441 | 11/1968 | Rhynz | 220/4.28 |
| 3,540,385 | 11/1970 | Hobart | 108/52.1 |
| 3,557,512 | 1/1971 | Braeuninger et al. | 108/51.1 |
| 3,678,868 | 7/1972 | Hirota | 108/51.1 |
| 3,720,176 | 3/1973 | Munroe | 108/51.1 |
| 3,811,597 | 5/1974 | Frankenberg et al. | 220/306 |
| 3,814,280 | 6/1974 | Ward | 220/73 |
| 3,878,796 | 4/1975 | Morrison | 108/901 |
| 3,974,934 | 8/1976 | Rohner | 220/4 F |
| 3,984,027 | 10/1976 | Smith | 220/306 |
| 3,987,924 | 10/1976 | Uitz | 220/76 |
| 3,989,140 | 11/1976 | Crane | 206/597 |
| 4,173,287 | 11/1979 | Kumakawa | 220/4.28 |
| 4,201,311 | 5/1980 | Underwood | 220/354 |
| 4,305,504 | 12/1981 | Bredal | 220/345 |
| 4,388,998 | 6/1983 | Underwood et al. | 220/354 |
| 4,402,397 | 9/1983 | Spence | 220/4.28 |
| 4,470,518 | 9/1984 | Stein | 220/346 |
| 4,765,252 | 8/1988 | Shuert | 220/4.28 |
| 4,785,957 | 11/1988 | Beck et al. | 220/4.28 |

PLASTIC CONTAINER AND PALLET SYSTEM

This is a division, of application Ser. No. 07/865,124 filed Apr. 8, 1992 which is a division of application Ser. No. 07/685,999 filed Apr. 12, 1991 (now U.S. Pat. No. 5,123,533) which is, in turn, a continuation of application Ser. No. 07/587,456 filed Sep. 19, 1990 (now abandoned), a continuation of application Ser. No. 07/449,500 filed Dec. 1, 1989 (now abandoned), a continuation of application Ser. No. 07/336,597 filed Apr. 7, 1989 (now abandoned), a continuation of application Ser. No. 07/157,926 filed Feb. 18, 1988 (now abandoned), a continuation-in-part of application Ser. No. 06/389,703 filed Jun. 18, 1982 (now abandoned).

BACKGROUND OF THE INVENTION

The present invention relates in general to an improved plastic container and pallet system, and more particularly, to less expensive or reusable plastic shipping containers and pallet particularly useful in agricultural produce and office storage units.

DESCRIPTION OF THE PRIOR ART

Heretofore, shipping containers for agricultural produce, such as fruit, vegetables, and flowers have been fabricated of glued corrugated paper, or of assembled wooden pieces. The problem with the use of corrugated paper containers is that they are not impervious to moisture and thus deteriorate in use. Moreover, the corrugated paper containers are not reusable and in many cases do not include sufficient ventilation for the produce requiring same. Wooden containers, in order to minimize their weight, are often manufactured from very thin wooden pieces which are subject to being broken easily. Wooden containers also present problems in that they are not impervious to moisture, often severely mildew and damage the produce enclosed therein and are generally not reusable.

Plastic agricultural boxes are also known from the prior art, however, other than those boxes disclosed in U.S. Pat. No. 3,987,924 are injection molded. Injection molded boxes are relatively expensive due to the relatively long cycle time required for the injection molding machinery used to mold such a relatively large item.

It is also known from the prior art to provide an injection molded plastic pallet and there are many examples of same. They range from a large single piece pallet to those which are constructed from a plurality of identical pieces. An example of a single piece molded plastic pallet is disclosed in U.S. Pat. No. 3,636,888 to Angelbeck. An example of a two-piece, full size molded plastic pallet wherein the two pieces are vibration welded one to the other, is disclosed in French Patent 2,387,850. Another approach is to provide a number of various shaped interlocking pieces which can be assembled to generate various sized pallets from very small to very large. Such a pallet which employs snap-together pieces is disclosed in U.S. Pat. No. 3,307,504 to Cloyd et al and an example of one which uses clamps for interlocking each of the pieces is German Offenlegungsschrift, 2,241,289. An example of a bolt-together pallet utilizing two standardized molded plastic parts is disclosed in German Offenlegungsschrift 2,057,361. And, finally, a pallet which employs a plurality of a single shaped part is disclosed in U.S. Pat. No. 3,277,849 to Talbot.

Each of the pallet references discussed above presents one or more problems. The first four references include very large pieces which through the injection molding process will be very costly and time-consuming to manufacture. Additionally, because of their large size, they are very bulky and hard to ship, even unassembled. A pallet manufactured as per the disclosure of the second mentioned German referenced is somewhat labor intensive to assemble since the individual pieces must be bolted together. The pallet of the final reference is undesirable since the individual pieces which make it up are not affixable, one to the other, and, therefore, create a situation where the pallet can only be lifted from two sides, otherwise, it will fall apart during lifting.

SUMMARY OF THE INVENTION

In accordance with the illustrated embodiments, the present invention provides plastic packing and storage containers, a plastic pallet for mounting same, and means for integrating the containers and the pallet together as a single unit. One of the plastic containers of the current invention includes a pair of plastic end wall structures which are fixed to opposite ends of an intermediate plastic wall structure. Each of the end wall structures includes a pair of generally narrow side edges spaced apart by a pair of generally parallel broad top and bottom side edges. The narrow side edges each include an upwardly directed tab portion at opposite ends for mating with recessed regions in an adjacent container, when the containers are stacked in vertical relation. Each of these upwardly directed tab portions further defines a trapezoidal notch opening upward with the surface of deepest extent being substantially parallel to the broad top edge of the end wall structure.

Another embodiment of the plastic container of the present invention includes a pair of plastic end wall structures together with an intermediate plastic wall structure which is affixed therebetween. Additionally, a lid structure is provided having a pair of spaced apart end edge portions with a multiplicity of tabs extending outward therefrom. The end wall structures each include a pair of generally narrow side edges spaced apart by a pair of generally parallel broad top and bottom side edges with the broad top edges including at least one upper lug means spaced apart from at least one lower lug means with their primary surfaces being generally parallel to the broad top edge. Each of the upper lug means of the end wall structures is disposed to retain one of the lid tabs when the lid is closed on the intermediate plastic wall structure and being offset from the lid tabs when the lid structure is generally offset from the intermediate plastic wall structure.

The third plastic container of the present invention includes a pair of plastic end wall structures with an intermediate plastic wall structure therebetween made up of a fixed portion and a removably affixed portion. The fixed portion of the intermediate wall structure includes one side, the bottom and a lower lip portion of the other side of the container. The removably affixed portion is a generally planar rectangular panel having attachment means along one edge for mating with a lower lip portion to provide closure of the container.

Another container of the present invention also includes a fixed portion and a removably affixed portion of the intermediate wall structure. In this embodiment, the fixed portion includes a first side, a bottom, and a second side, with the second side defining a generally rectangular opening therethrough. The removably affixed portion includes a generally rectangular panel for providing closure of the second side when it is inserted within the container.

The pallet of the present invention includes a selected number of extruded base runners having a generally rectangular cross section, and a selected number of extruded cross members also having a generally rectangular cross section and being affixed between the base runners. Each of the base runners and cross members includes an external shell defining an interior cavity into which an insert is retained to strengthen the base runner and/or cross member. Within the cavity of the external shell, channels are provided for mating with lugs formed on the insert. Additionally, the base runner external shell includes a pair of rails affixed to one surface which run generally parallel to the longitudinal axis of the base runner to provide feet therefor. These rails also define a trapezoidal notch therebetween. Each of the cross members include a multiplicity of tabs spaced apart one from the other and generally perpendicular to one of the longitudinal sides of the cross member. These tabs are generally located above a base runner and extend up and away from the base runner.

Another embodiment of the present invention includes a light-weight container system which includes a plurality of stackable plastic containers and a plastic pallet. This system includes any one of the containers previously described together with a pallet as described above. Thus, in this configuration, the tabs affixed to the cross members of the pallet are disposed for mating with recessed regions in an adjacent container when the containers are stacked on the pallet. Additionally, by aligning the base runner directly below the narrow side members of the end wall structures of the containers, a strap can be placed in the notch beneath each of the base runners, extended upward across the exterior faces of the containers stacked on the pallet, and the loop is completed with the strap connecting with itself across the top of packing containers while being retained within the trapezoidal notches in the end structures of the top level containers directly above that base runner.

Other features and advantages of the present invention will become apparent upon a perusal of the following specification taken in connection with the accompanying drawings described herewith:

DESCRIPTION OF THE PREFERRED EMBODIMENTS

Figure 1:
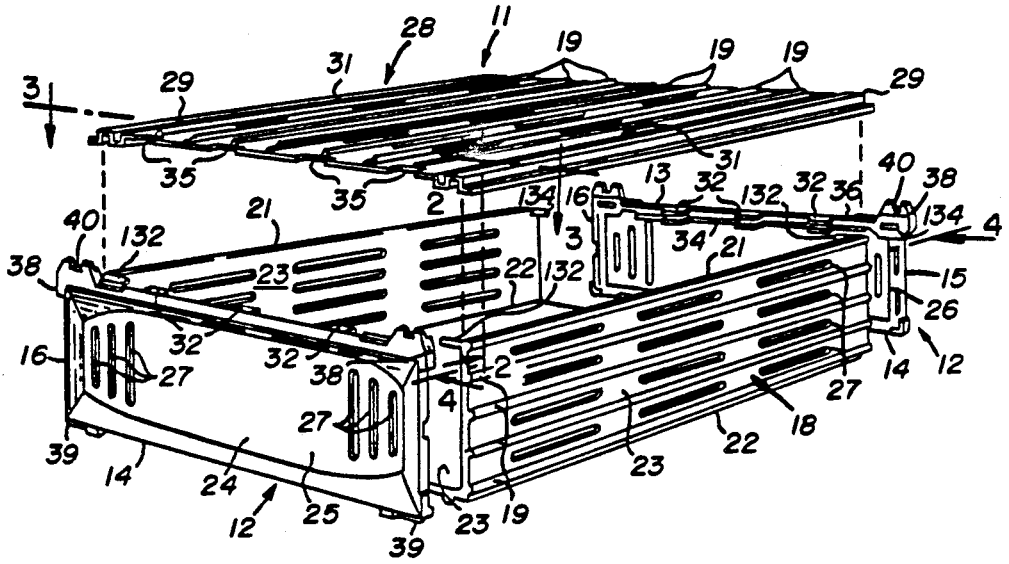
FIG. 1 is an exploded perspective view of a plastic container incorporating features of a first embodiment of the present invention

Referring now to FIG. 1, there is shown a plastic container 11 for agricultural produce such as fruits or vegetables. The container 11 contains a pair of end wall structures 12, preferably made by injection molding of a structural foam material such as polypropolene foam. The end wall structures 12, in general, form a frame having a pair of broad top and bottom parallel side edges 13 and 14, respectively, interconnected by a pair of generally parallel narrow side edges 15 and 16, respectively.

An intermediate wall structure 18 is provided for connection to the end wall structures 12. The intermediate wa structure 18 is made of a plastic material such as a high impact styrene or polypropolene, and is preferably formed by extrusion.

Figure 4:
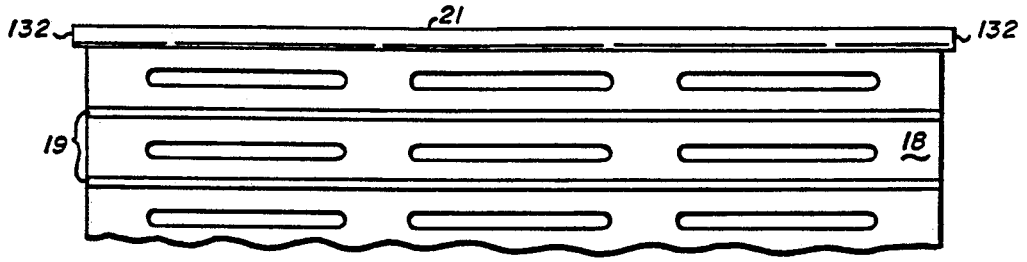
FIG. 4 is an enlarged sectonal view of a portion of the structure of FIG. 1 delineated by line 4—4.

The intermediate wall structure 18 includes a plurality of reinforcing ribs 19 extending longitudinally of the container 11 parallel to the side lip portions 21. The extension of lip 21 beyond each of the edges of wall 18 are ears 132 bent inward at 90° to the side of container 11 (see FIG. 4). In a preferred embodiment, the extruded intermediate wall structure 18 includes pair of hinge portions 22 intermediate two reinforcing ribs 19 and parallel thereto. Wall structure 18 is bent through 90° at either side to form a U-shaped structure having adjacent web portions 23. During the bending process of intermediate wall structure 18, a moderate amount of heat and pressure is applied to hinge portions 22 when the bending is done to cause permanent deformation of intermediate wall structure 18 into the above-described U-shaped structure. During this process, ears 132 are also bent inward.

End wall structures 12 and intermediate wall structure 18 can be assembled by several well-known methods including gluing and vibration welding. Vibration welding is the preferred technique. In either case, end wall structure 12 mates with the end of intermediate wall structure 18 with web portions 23 being adjacent to narrow side edges 15 and 16 and bottom side edge 14 of end wall structure 12. Further discussion of the assembly of these pieces is included below in the discussion of FIGS. 5*a* and 5*b*.

End wall structures 12 have a central opening 24 in which insert 25 is mounted. Insert 25 is generally planar and rectangular in shape having graphics printed thereon for display through opening 24 to indicate the source of the enclosed produce. Insert 25 is also made of a plastic material such as high impact styrene or polypropolene and is preferably formed by extrusion. The insert 25 is secured within rectangular recess 26, at the inside of end wall structures 12, by a suitable adhesive, cement or vibration welding. Vibration welding is the preferred method for mounting insert 25. Insert 25 is perforated to facilitate ventilation of container 11. In addition, the intermediate wall structure 18 includes a multitude of elongated perforations 27 for ventilation of container 11.

Figure 2:
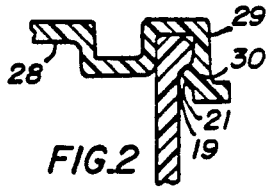
FIG. 2 is an enlarged sectional view of a portion of the structure of FIG. 1 delineated by line 2—2

A plastic lid structure 28 is provided for closing off the top of intermediate wall structure 18. The lid 28 includes a resilient channel 29 disposed along the side lips of the lid 28 for releasably gripping (clipping to) the upper side lip 21 of the side wall panels as shown in FIG. 2. In this design, the resilient channel 29 captures approximately 225° of lip 21. This is accomplished by inclusion of snap lip 130 within the U-shaped channel 29 to meet with the lower outer edge of lip 21. Additionally, this design provides support for the top edge of each side of the packing box 11 when lid 28 is snapped in place. Finger grip holes 31 are provided near the side edges of lid 28, generally midway lengthwise to the lid, to facilitate closure and removal of lid 28. Lid 28 also includes reinforcing ribs 19 running parallel, one to the other, over the full width of lid 28. In addition, pairs of upper and lower lugs 32 and 34, respectively, are provided along the top side edge of each end wall structure 12 to mate with lid tabs 35 when resilient channels 29 are mated with side lip portions 21 (see FIGS. 3*a*, 3*b*, 5*a* and 5*b*).

Figure 3A:
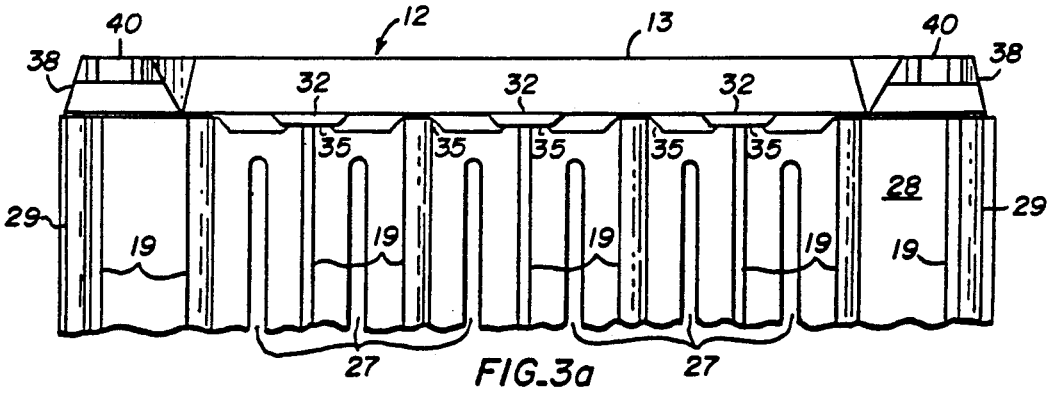
FIG. 3*a* and 3*b* are enlarged sectional view of a portion of the structure of FIG. 1 delineated by line 3—3.
Figure 3B:
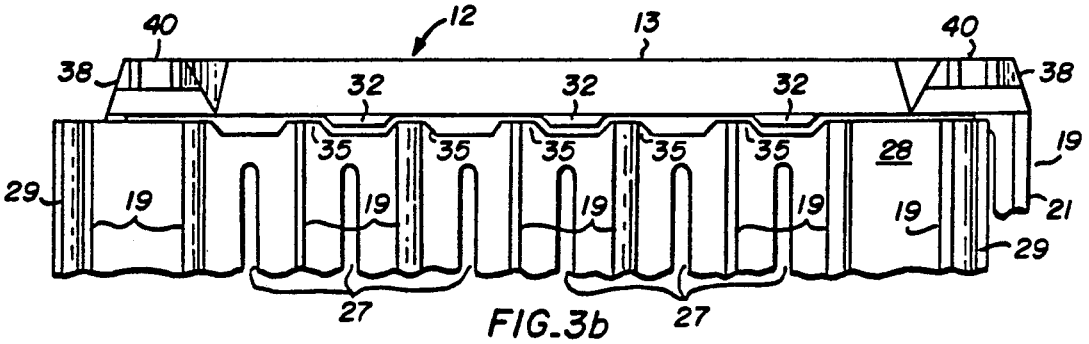
Figure 5A:
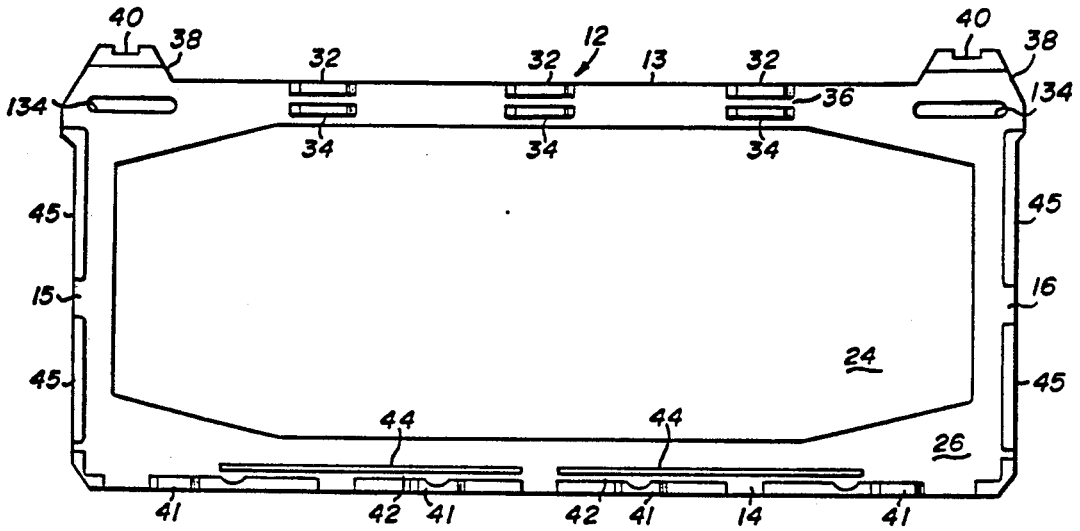
FIG. 5*a* and 5*b* are plain interior surface views of the end portion of the container shown in FIG. 1.
Figure 5B:
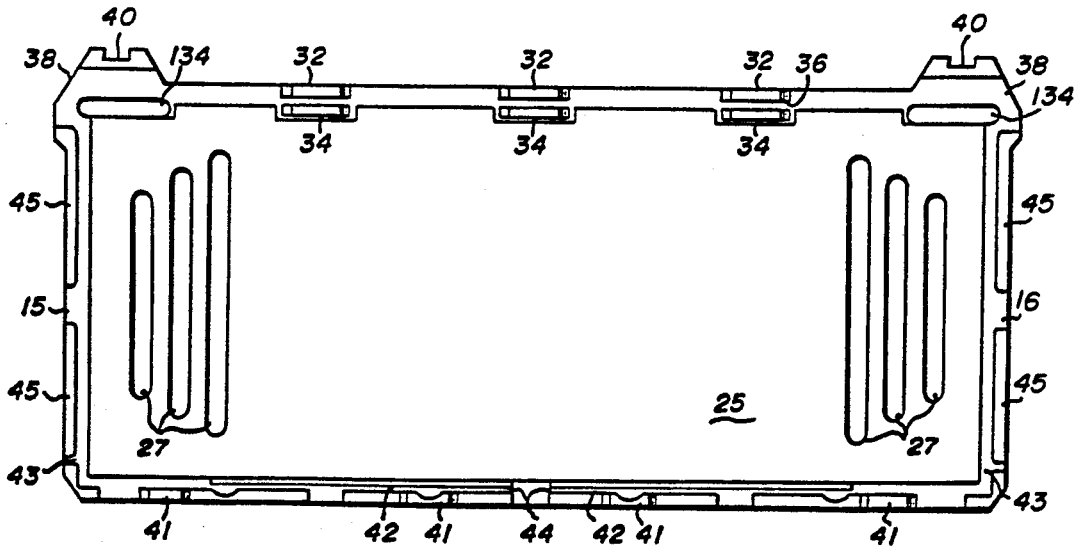

In FIG. 3*a*, lid 28 is shown in place and locked with intermediate wall structure 18. In this position, three of lid tabs 35 are aligned with upper lugs 32. To remove lid 28, resilient channels 29 must be released from side lip portions 21 and lid 28 slid in either direction until lid tabs 35 clear upper lugs 32 of end wall structure 12 as shown in FIG. 3*b*. It should be noted that in this position one of resilient channels 29 is extending beyond one side of intermediate walls structure 18, while the other resilient channel 29 is over the interior of the container 11 created by intermediate wall structure 18. In this position, lid 28 may be lifted straight up and off box 11. To close box 11, the above steps are simply reversed. In FIGS. 5*a* and 5*b*, lid channel 36 created by upper and lower lugs 32 and 34 can be seen. By including lower lugs 34, support for lid 28 against downward pressure is provided along end wall structures 12 by means of lid tabs 35 which are disposed between upper and lower lugs 32 and 34, respectively. To provide additional support for lid 28, downward forces lower lugs 34 could be replaced with a single lower lug extending over a substantial portion of the top side edge 13 of each end wall structure 12. By doing so, each of lid tabs 35 would be supported, not only those also captured by upper lugs 32.

As shown in FIGS. 1, 3*a* and *b*, and 5*a* and *b*, the end wall structures 12 each include a pair of upwardly directed stacking tabs 38 at opposite ends of upper edge 13. The stacking tabs 38 meet with stacking recesses 39 provided at opposite ends of the bottom broad side edges 14 to prevent relative sliding movement between vertically stacked containers 11. Additionally, each stacking tab 38 includes a strap notch 40 for interconnecting the stacked containers 11 with the pallet system to form a single shippable unit. This feature will be discussed more fully after introduction of the pallet assembly. The lid 28 includes a multitude of elongated perforations 27 to facilitate ventilation of the container 11. The lid is preferably formed by extrusion.

Referring again to FIGS. 5*a* and 5*b*, FIG. 5*a* shows the inner surface of end wall structure 12, including recesses 26 and 134, bottom lugs 41 and positioning bars 44. FIG. 5*b* shows insert 25 having been mounted within recess 26 with its lower edge abutting positioning bars 44. As discussed above, insert 25 is mounted preferably by means of vibration welding. With insert 25 in place, it can be seen that its upper edge assists in the definition of lid channel 36 between upper and lower lugs 32 and 34. Its side edges, in conjunction with edge bars 45, create assembly channel 43 which together with assembly channel 42 created by positioning bars 44 and bottom lugs 41, define the mating area wherein the end of intermediate wall structure 18 is interconnected with the end wall structure 12. Bottom lugs 41 and edge bars 45 provide additional support to intermediate wall structure 18 in opposition to forces from within the container 11. Recesses 134 are provided to capture ears 132 of intermediate wall structure 18.

In the manufacture of lid 28 and intermediate wall structure 18, the web and reinforcing ribs 19 are preferably integrally formed in the extruded plastic part and the extruded sheet is cut laterally into sections of the proper length and to form ears 132. The perforations are punched to provide the ventilation holes 27.

The plastic container 11 in the knock-down stage comprises a number of relatively flat portions that may be shipped without occupying excessive volume. The containers are readily assembled in the field or at the packing house by folding up the side panel portions of the intermediate wall structure 18 and welding the end wall structures 12 into place against the end edges of the intermediate wall structure 18. The plastic container 11 may be readily reclaimed and recycled by grinding up the plastic parts and reusing the plastic material as a charge for the extruder utilized to extrude the intermediate wall structure 18, lid 28 and insert 25. Due to the provision of the extruded lid 28 side wall 18 and insert 25 the manufacturing cost of the plastic container 11 is substantially reduced as compared with prior containers of the paper, wooden or plastic molded type. Since container 11 is constructed entirely of a plastic material, it may be utilized as both a shipping and display container meeting all FDA regulations, since the material will not absorb any juices from the fruits or vegetables contained therein, thus, eliminating the growth of mildew in or on the container while being displayed in the produce section of the grocery.

Figure 6:
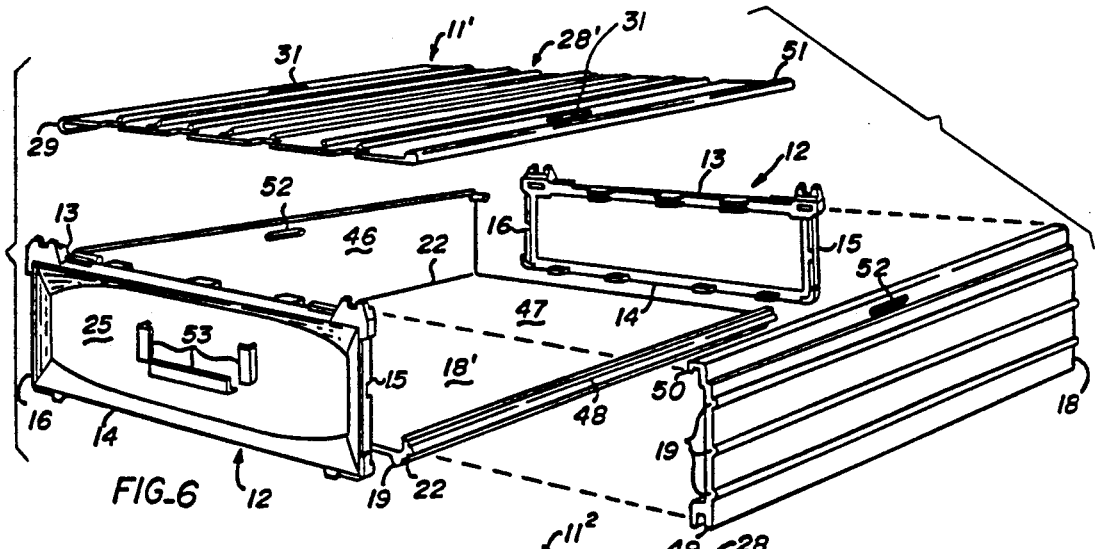
FIG. 6 is an exploded perspective view of a storage container similar to the container of FIG. 1 depicting a second embodiment of the present invention.

Reffering now to FIG. 6, there is shown an alternative plastic container 11'. Container 1l' is essentailly the same as container 11 of FIG. 1, with the exception that the intermediate wall structure consists of two pieces, 18' and 18''. Intermediate wall structure 18' consists of back wall 46, bottom 47 and front lip 48. Front lip 48 extends vertically upward from bottom 47 creating a portion of the front wall of container 11'. The remainder of the front wall consists of wall structure 18''. When container 11' is closed, groove 49, along the lower edge of wall structure 18'', mates with front lipped 48 of wall structure 18' in a tongue-in-groove fashion. Wall structure 18'', along its upper edge, includes a resilient channel 50 which when closed upon lid 28' mates with lip 51 in a similar manner to the mating method in FIG. 2. The back edge of lid 28 mates with the upper of back wall 46 in the same manner as that discussed in FIG. 2 for container 11 of FIG. 1. Additionally, when closed, container 11' can be locked by interconnecting locking hole 52 with finger grip hole 31 by a metal or plastic seal or lock having a long hasp.

Container 11' also differs from the packing container 11 of FIG. 1 in that there are no perforations and insert 25 at one end of the container has been punched to provide an identification card holder 53. Wall structure 18'' is also narrowed to clear edge bars 45 along the inner surfaces of end wall structures 12.

Figure 7A:
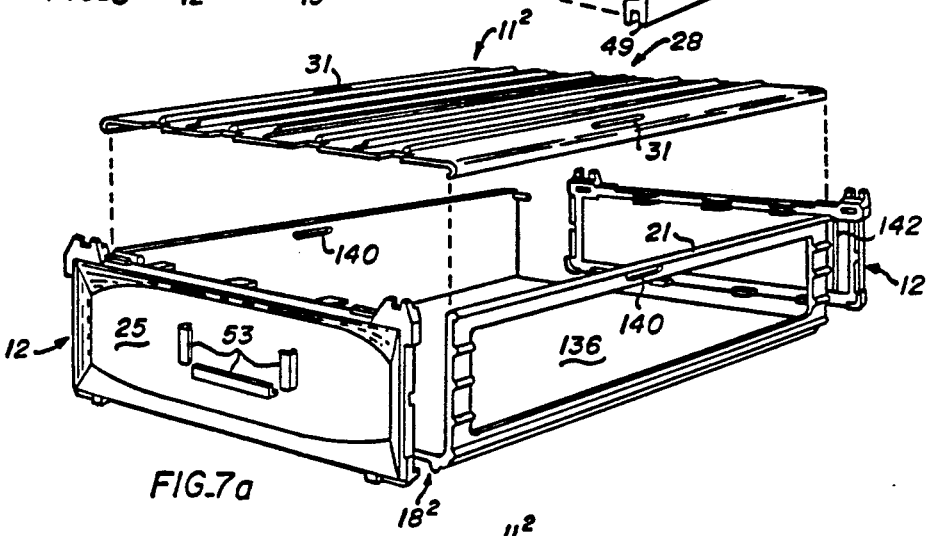
FIG. 7*a* and 7*b* are exploded perspective views of a storage container similar to the container of FIG. 1 depicting a third embodiment of the present invention.
Figure 7B:
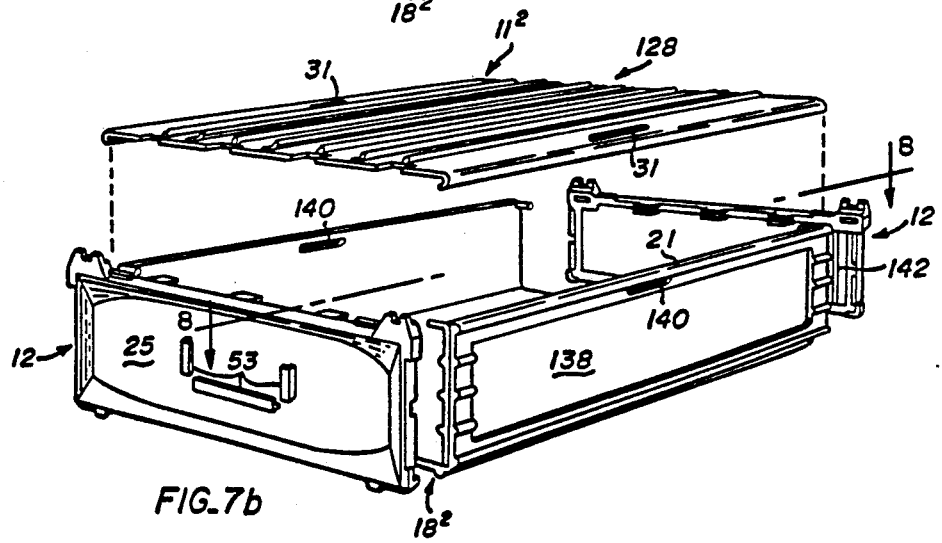
Figure 8A:
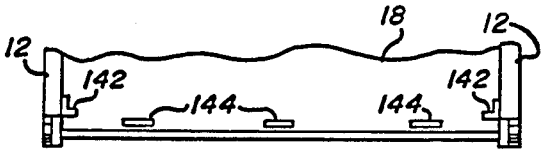
FIG. 8*a* and 8*b* are each an enlarged sectional view of a portion of the structure of FIGS. 7*a* and 7*b* delineated by line 8—8.
Figure 8B:
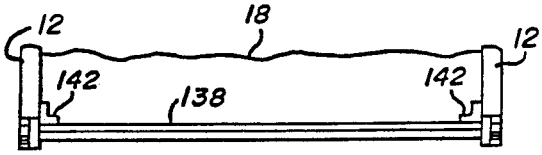
Figure 9:
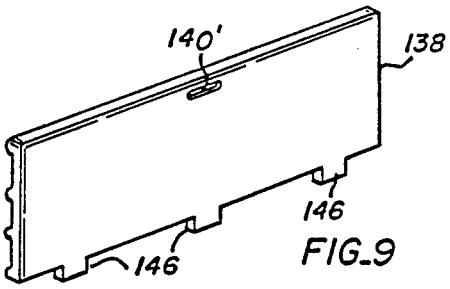
FIG. 9 is a perspective view of the door for providing closure of the storage container of the type shown in FIGS. 7*a* and 7*b*, FIG. 10*a*, 10*b*, and 10*c* are plain views of the top, front, and side, respectively, of a pallet design incorporating the features of the present invention.

Referring now to FIGS. 7*a* and *b*, 8*a* and *b*, and 9, there is shown an alternate storage container 11². Container 11² is also essentially the same as container 11 of FIG. 1, with the exception that there are no ventilation perforations and an access hold 136 has been punched in one side of intermediate wall structure 18². Access hole 136 is less than the full width or height of the side wall through which it is punched.

Closure of access hole 136 is provided by means of hatch 138. Hatch 138 is made of the same material as wall structure 18² by extrusion and then cut to form tabs 146. Additionally, hatch 138 is cut having a width which is less than the interior spacing between end wall structures 12. Closure of container 11² is accomplished by slipping hatch 138 between the inner surface of wall structure 18² and "L"-brackets 142 (also of the same material) welded to the inner surface of isnerts 25 in both of the end walls 12. Tabs 146 of hatch 138 extend through slots 144 in the bottom of wall structure 18². When hatch 138 is in place, lid 28 is snapped over lip 21, as in FIG. 2, capturing both wall structure 182 and the top edge of hatch 138. If a more positive lock is desired, the hasp of the lock can be passed through finger hole 31 of lid 28, and locking holes 140 and 140' in wall structure 18 and hatch 138, respectively.

Figure 10:
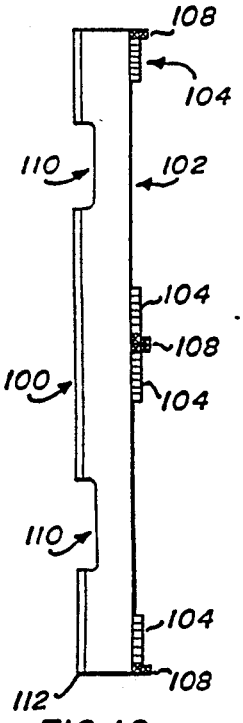
Figure 10A:
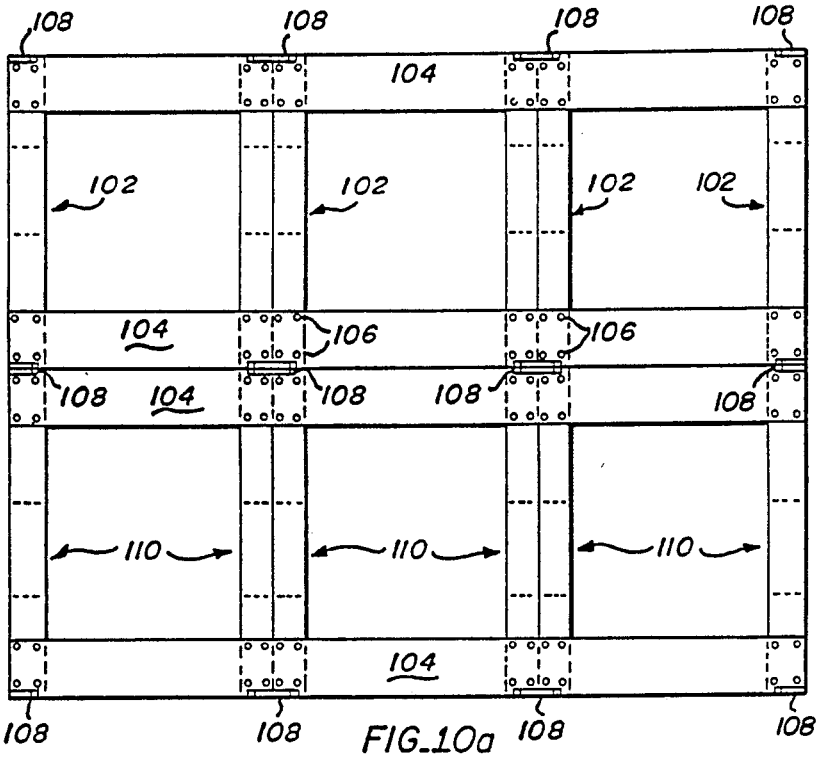
Figure 10B:
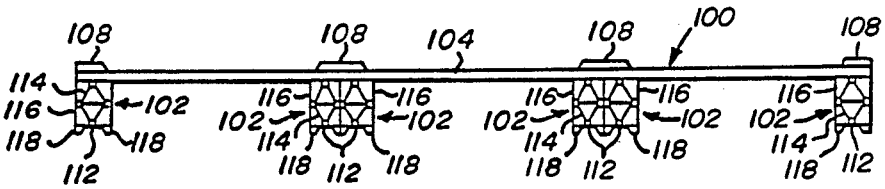
Figure 12:
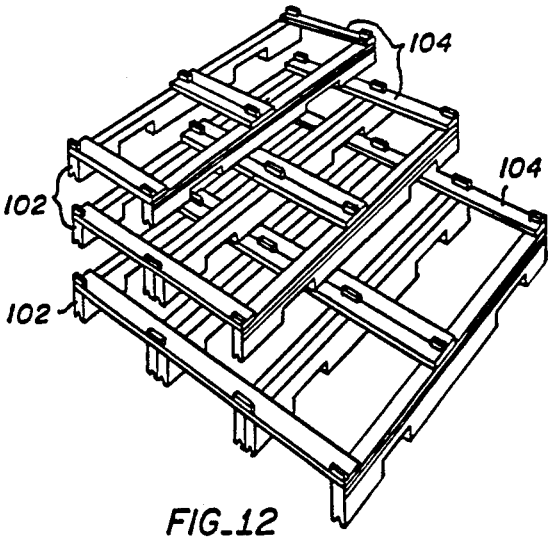
FIG. 12 is a composite perspective view showing three sizes of the pallet design shown in FIGS. 10*a*, *b* and *c*.
Figure 11:
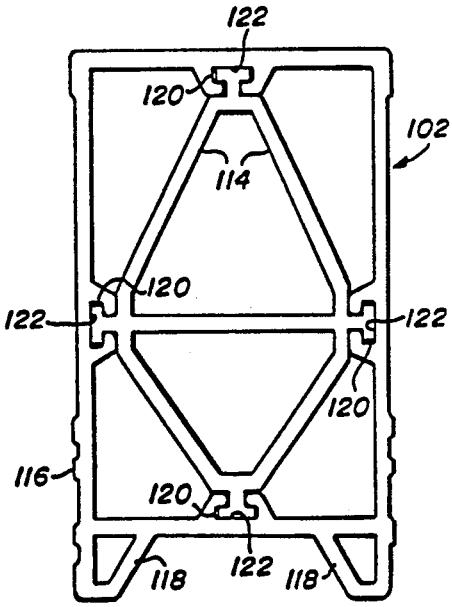
FIG. 11 is a cross-sectional view of the base runner portions of the pallet as shown in FIGS. 6*a*, *b* and *c*.

Referring now to FIGS. 10*a*, *b* and *c*, there is shown a pallet 100 for accommodating six containers per level of the type shown in FIGS. 1, 6 or 7*a* and b stacked three across and two deep. Pallet 100 consists of two basic units: base runners 102 and cross members 104. By selecting the length of each of these untis, a pallet may be assembled to accommodate containers 11 or 11' in a configuration one, two or three containers wide and one or two containers deep (see FIG. 12). As shown in FIGS. 10*a*, 11, base runners 102 consist of two pieces, an external rectangular portion 116 having feet 118 and an interior substantially diamond shaped insert 114. Inclusion of feet 118 on the lower extremity of external rectangular portion 116 creates belt notch 112 which will be addressed more fully below. Internal to external rectangular portion 116 are provided channels 122 which mate with lugs 120 of insert member 114. Both insert 114 and external portion 116 are extruded from, for example, high impact styrene or polypropolene, and then cut to the desired length. Base runner 102 is assembled by sliding insert 114 into external portion 116 with lugs 120 being captured by channels 122 and the entire assembly being vibration welded. Next, to additionally provide fork-lift access to the side of the stack of containers 11, fork-lift notches 110 are sheared from the lower portion of base runners 102 with the appropriate spacing therebetween.

Each of cross members 104 also include mating tabs 108 with selected spacing for mating stacking recesses 39 of the first layer of containers al or 11' stacked on pallet 100. Cross members 104, when extruded, include a short vertical spine along one edge. This spine is selectively sheared to create mounting tabs 108 of the proper size and spacing and cross member 104 is cut to the desired length. The material for cross members 104 is, for example, high impact styrene or polypropolene, and is extruded in a honeycomb pattern as shown in FIG. 10*c*. The final assembly of pallet 100 is completed by placing cross members 104 on base runners 102 perpendicularly with the base runners being positioned beneath mating tabs 108. Pallet 100 may then be vibration welded or stake welded by means of access holes 106 extending through cross members 104 into base runners 102. If stake welding is used, the stake welder produces a thermal compression bond between the lower sheet portion of cross member 104 and the upper sheet portion of base runner 102.

By constructing pallet 100 of high impact styrene or polypropolene and using a honeycombed interior pattern in both base runner 102 and cross member 104, one achieves a lightweight pallet with exceptional strength which can be assembled in the field, as can containers 11. Pallet 100 may also be readily reclaimed and recycled by grinding up the plastic parts and reusing the plastic material as a charge for the extruder, as was true for container 11.

Figure 13:
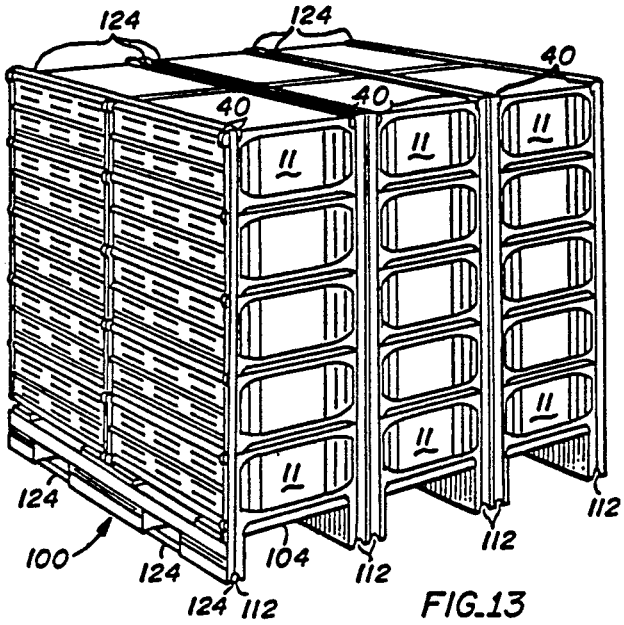
FIG. 13 is a perspective view showing the total packing container and pallet system with the containers of FIG. 1 on the pallet of FIGS. 10*a*, *b* and *c*.

Referring now to FIG. 13, there is shown an integrated pallet 100 and 30 containers 11 mounted thereon. Containers 11 are secured to pallet 100 by means of pallet straps 124 which pass beneath each of base runners 102 in belt notches 112, extend upward across the end wall structures 12 of containers 11, pass through strap notches 40 of the top containers 11, as it extends across the top of containers 11, and down the back side of the stack. These straps can be of any strong nonstretching plastic material and can be fastened together by any known method, e.g., thermal bonding or crimp connectors.

Figure 14:
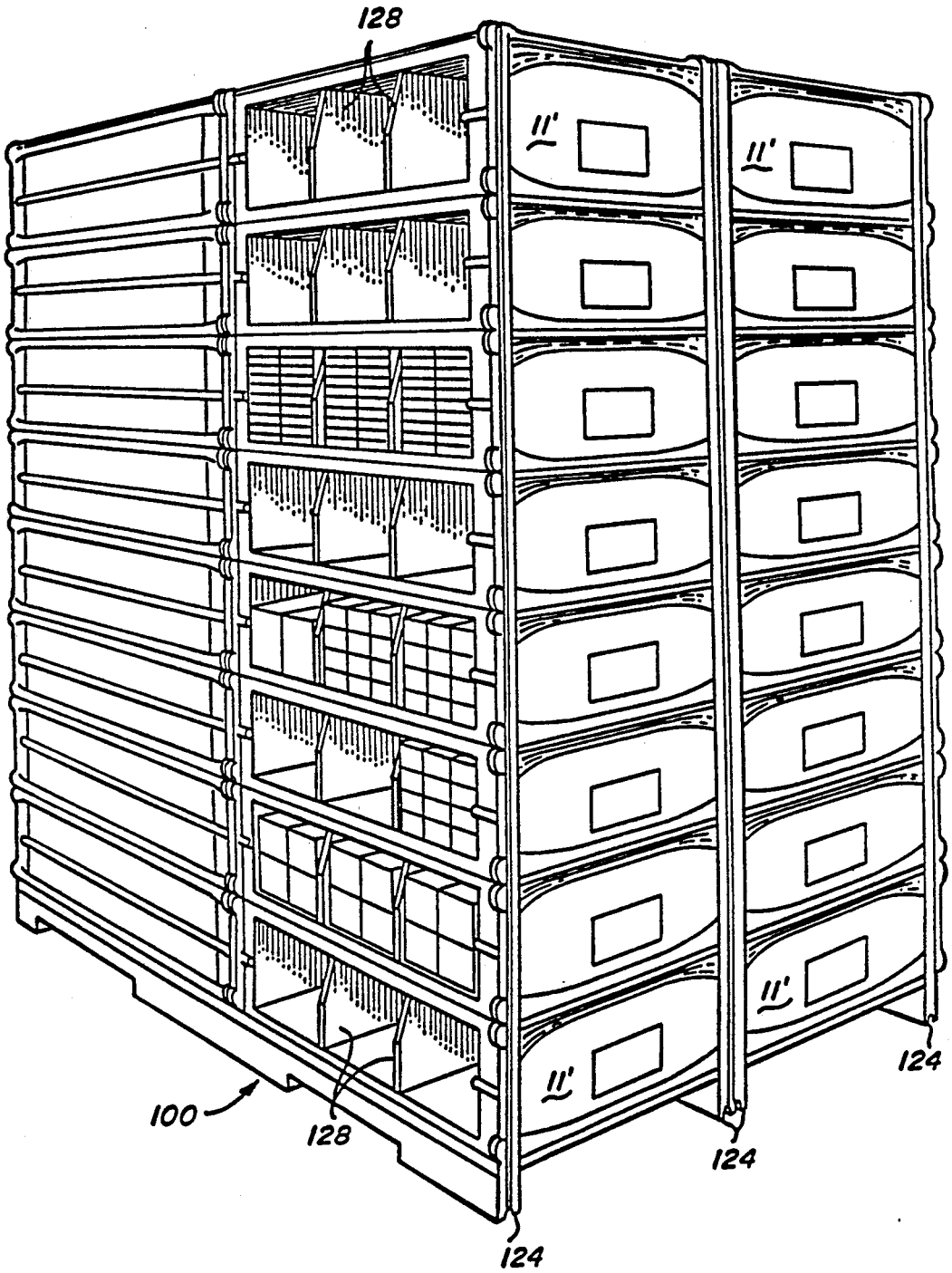
FIG. 14 shows a perspective view of the incorporation of the packing containers of FIGS. 6 or 7*a* and 7*b* with the pallet system of FIGS. 10*a*, *b* and *c* forming a stationary storage unit.

Referring now to FIG. 14, there is shown a similar stacked system incorporating pallet 100 and 32 containers 11' or 11². This system is also tied together by means of straps 124 in the same manner as discussed in relation to FIG. 13. Also shown are removable dividers 128 within container 11' for storage flexibility.

Figure 15:
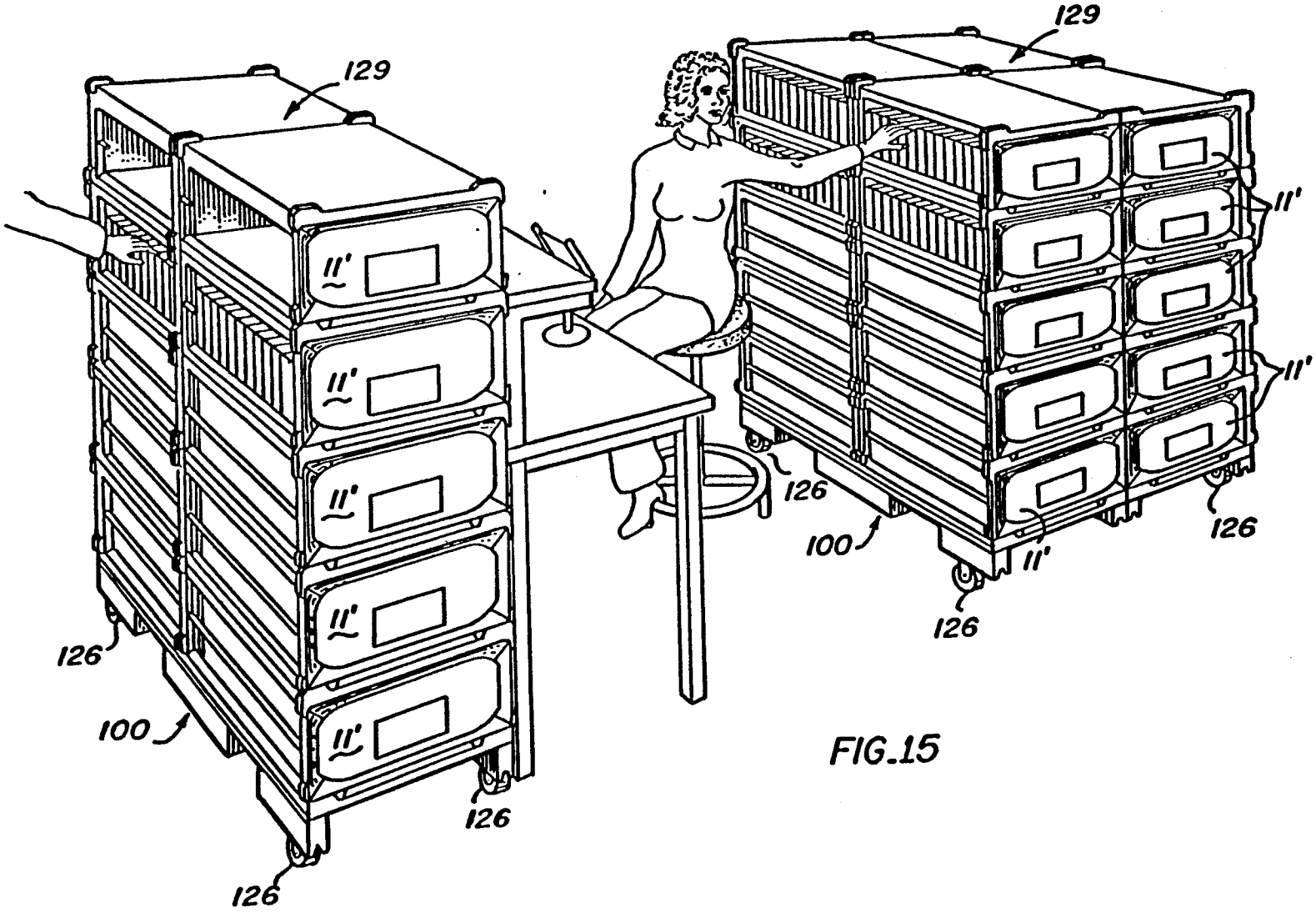
FIG. 15 shows a perspective view of the storage containers of FIGS. 6 or 7*a* and 7*b* together with the pallet system of FIGS. 10*a*, *b* and *c* forming mobile storage units.

Referring now to FIG. 15, there are shown mobile storage units 128. Each of these units includes a pallet 100 having four wheels 126 and a selected number of containers 11' mounted thereon.

Figure 16:
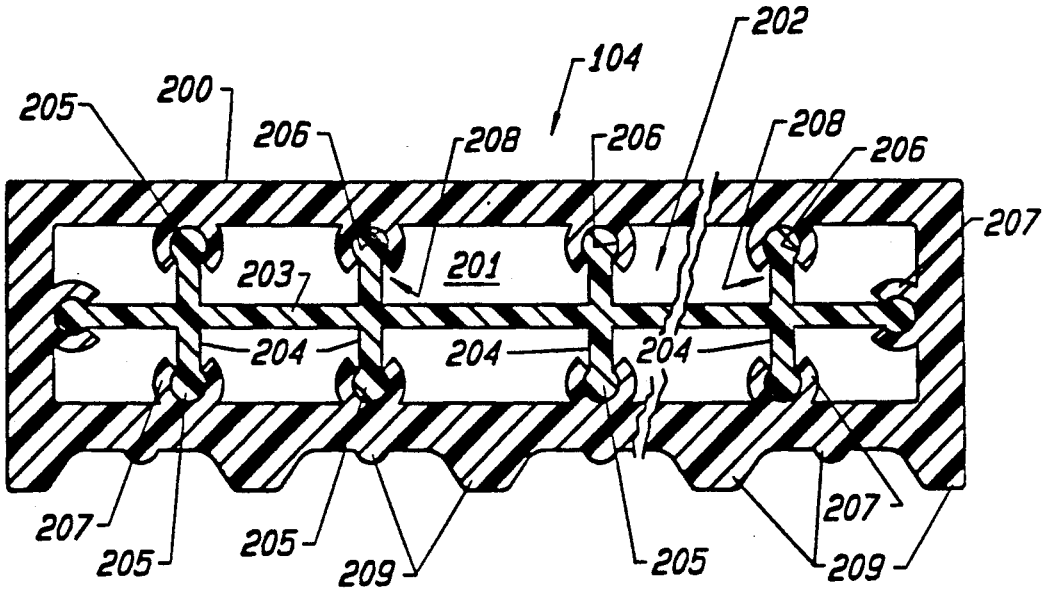
FIG. 16 is a transverse cross-sectional view of an alternative cross member portion of the pallet of the present invention.

Referring now to FIG. 16, there is shown an alternative cross member portion 104' of the pallet of the present invention (see FIGS. 10). In this embodiment, the cross member 104' includes an elongated plastic extruded hollow shell 200, as of polypropelene. The shell 200 defines an interior cavity 201 of generally rectangular cross section. An elongated extruded plastic cross bracing insert 202 is slidably inserted within the cavity 201 for cross bracing the composite cross member 104'.

The cross bracing insert 202 includes a central web or plate portion 203 disposed substantially in the mid-plane between the two major faces of the shell 200. A plurality of cross portions 204 extend away from the web 203 from opposite major faces and from the opposite side edges thereof toward the inside walls of the cavity 201.

The rib portions 204 extend the full length of the cross member 104' and include enlarged cylindrical lug portions 205 at the outer terminal side edges of the rib portions 204. The cylindrical lug portions 205 are slidably received within and interlocked within cylindrical receiving cavities 206 formed by the extrusion process in rib-shaped projections 207 projecting inwardly of the side walls of the shell structure 200. The rib-shaped projections 207 are apertured with elongated apertures 208 communicating with the receiving cavities 206 for passage of the rib portions 204 of the cross bracing insert therethrough.

Energy concentrating ribs 209 are extruded into one outside major face of the shell 200 of the cross member portion 104' for vibration welding to the base runner portions 102 of the pallet. Some of the energy concentrating ribs 209 are larger than the others for protruding into the base runner 102 and interlocking the same during the vibration welding process.

In a typical physical realization of the cross member portion 104', the shell 200 is 0.06" thick, 3.5" wide and 0.750" high. The web 203 is 0.06" thick. The ribs 204 are 0.06" thick and 0.150" high exclusive of the cylindrical lug portions 205 which have a diameter of 0.130". The ribs 204 are on 0.350" centers across the web 203. The energy concentrators 209 have heights of 0.020" and 0.060", respectively. Typically, there is a 0.005" gap between the cylindrical lug 205 and the inside wall of the cylindrical cavity 206.

In fabrication, the polypropolene shell 200 is extruded within an extrusion die at about 350° F., thereafter, the hot extrusion is pushed through a cooling or sizing fixture approximately 6 feet long in which the extrusion is cooled from about 250° F. to about 150° F. As the shell 200 passes through the extruding die, it is cooled on its interior by a spray of cold water.

The cross bracing insert is similarly extruded and cooled by passing through a water cooled sizing die.

The cross bracing insert 202 is pushed by a hydraulic ram axially into the shell 202. Thereafter, the composite cross member 104' is cut to the exact length by a high velocity water jet.

An advantage of the cross member 104' is that it is free of distortion which is otherwise encountered when the honeycomb member is produced by a single extrusion due to the inability to properly remove the heat from the internal cross bracing web portions.

A container pallet system such as the one disclosed above has many advantages. Not only are each of the units which make up the system strong, they additionally are less than one-third the weight of conventional crate and pallet systems. The temperature range over which they lend themselves without deterioration is also of interest. The styrene or polypropolene material can withstand a broad range of temperatures extending from those encountered in a deep freeze, to temperatures much greater than those in very hot climates. Furthermore, these units may be steam-cleaned for reuse, if desired. Bacteria will not grow on these types of plastic, therefore, the produce need not be removed from the container before being put on retail display.

The entire system, by means of its interlocking tabs and channels, eliminates sliding and shifting of the containers on the pallet during shipping, since each of the end wall structures 12 of the containers 11, 11' and 112 are molded in a precision mold with much greater uniformity from container to container than in the cardboard or wooden containers currently in use. Additionally, the stacking technique provides separation on all sides between each of containers 11 when stached one atop the other. Therefore, more ventilaton is provided in and around the contents of the container during shipment. Because of the increased air flow, less spoilage of the delicate produce enclosed within the containers will result, thus, increasing the yield to the retailer. Additionally, shipping charges will be reduced since the total weight of the assembled containers and pallet together is considerably reduced, resulting in increased profits to all concerned.

What is claimed is:

1. A plastic container for produce comprising:

a pair of plastic end wall structures;

an intermediate wall structure defining at least one axially extending side edge portion and at least one transversely extending end edge portion;

means for affixing said end wall structures to said intermediate wall structure along said transversely extending end edge portion of said intermediate wall structure;

a lid structure having a pair of spaced apart axially extending slide edge portions and a pair of spaced apart transversely extending end portions where in said end edge portions include a plurality of tab means extending outward axially therefrom toward said end wall structures;

each of said end wall structures including a pair of generally parallel side edges spaced apart by a pair of generally parallel top and bottom side edges, said top edges including at least one upper lug means protruding axially toward said lid structure; and said upper lug means being disposed to axially overlap and to retain one of said lid tab means when said lid structure is disposed in locking relation with the container, and said lug means being disposed in offset relation from said lid tab means when said lid structure is disposed in unlocking relation with the container.

2. The apparatus of claim 1 wherein said intermediate wall structure has a pair of said side edge portions spaced from one another and a pair of said end edge portions which are also spaced from one another.

3. The apparatus of claim 1 wherein each of said end wall structures comprises a molded plastic part.

4. The apparatus of claim 1 wherein each of said end wall structures comprises a molded plastic foam frame structure.

5. The apparatus of claim 1 wherein said intermediate wall structure includes a plurality of generally parallel rib portions disposed in generally parallel relation with said edge portions.

6. The apparatus of claim 1 wherein said intermediate wall structure including said ribs comprises a plastic extrusion.

7. The apparatus of claim 1 wherein said intermediate wall structure is perforated for ventilation.

8. The apparatus of claim 1 wherein each of said end wall structures comprises a plastic frame member, and insert means of a generally planar geometric configuration disposed within said frame.

9. The apparatus of claim 8 wherein said insert means comprises a plastic extrusion.

10. The apparatus of claim 8 wherein said insert means is perforated for ventilation.

11. The apparatus of claim 8 wherein said insert means is affixed to said frame member by vibration welding.

12. The apparatus of claim 1 wherein said lid structure includes a plurality of generally parallel rib portions disposed in generally parallel relation with said side edge portion.

13. The apparatus of claim 12 wherein one of said rib portions coincides with each of said tab means of said lid structure.

14. The apparatus of claim 12 wherein said lid structure including said ribs comprises a plastic extrusion.

15. The apparatus of claim 1 wherein said lid structure is perforated for ventilation.

16. The apparatus of claim 1 wherein each of said end wall structures further comprises at least one lower lug means having a major surface generally parallel to the broad top edge for providing support for the lid structure in opposition to forces from without the container by communicating with at least one tab means of said lid structure.

17. The apparatus of claim 16 wherein each of said upper and lower lug means are adjacent and spaced apart one from the other.

* * * * *